US011137705B2

(12) United States Patent
Fujii et al.

(10) Patent No.: US 11,137,705 B2
(45) Date of Patent: Oct. 5, 2021

(54) FIXING DEVICE, IMAGE FORMING APPARATUS

(71) Applicant: KYOCERA Document Solutions Inc., Osaka (JP)

(72) Inventors: Shunsaku Fujii, Osaka (JP); Takashi Eiki, Osaka (JP); Hiroki Kawasaki, Osaka (JP); Ryohei Tokunaga, Osaka (JP); Rina Kikukawa, Osaka (JP); Sadanori Nakae, Osaka (JP); Kotatsu Kawaguchi, Osaka (JP); Yuta Kitabayashi, Osaka (JP); Sara Fujikawa, Osaka (JP); Atsushi Kohama, Osaka (JP); Yuhiro Sakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/145,260

(22) Filed: Jan. 8, 2021

(65) Prior Publication Data

US 2021/0216029 A1 Jul. 15, 2021

(30) Foreign Application Priority Data

Jan. 14, 2020 (JP) ..... JP2020-003509

(51) Int. Cl.
*G03G 15/20* (2006.01)
*G03G 21/16* (2006.01)

(52) U.S. Cl.
CPC ..... *G03G 15/2053* (2013.01); *G03G 15/2039* (2013.01); *G03G 15/2064* (2013.01); *G03G 21/1652* (2013.01); *G03G 2215/2038* (2013.01)

(58) Field of Classification Search
CPC ..... G03G 15/2003; G03G 15/2039; G03G 15/2053; G03G 15/2064; G03G 21/1652; G03G 2215/2038
See application file for complete search history.

(56) References Cited

U.S. PATENT DOCUMENTS 7,277,654 B2 * 10/2007 DeMoor ..... G03G 15/5004 399/30
10,061,237 B2 * 8/2018 Cao ..... G03G 15/2039

FOREIGN PATENT DOCUMENTS

JP 2008-299205 A 12/2008

* cited by examiner

*Primary Examiner* — Hoang X Ngo
(74) *Attorney, Agent, or Firm* — Studebaker & Brackett PC

(57) ABSTRACT

The fixing device includes a cylindrical heated member and a heating part. The cylindrical heated member is long in a width direction of a sheet, and is supported in a rotatable manner with coming into contact with a fixing face of the sheet. The heating part is provided in an inner space of the heated member and heating an inner circumferential face of the heated member. The heating part includes a plurality of heaters disposed side by side in a longitudinal direction of the heated member; and a first temperature sensor measuring a first heater of the plurality of heaters or a heated area of the heated member heated by the first heater. The plurality of heaters and the first temperature sensor are connected in series by a first power supply line.

6 Claims, 5 Drawing Sheets

FIXING DEVICE, IMAGE FORMING APPARATUS

INCORPORATION BY REFERENCE

This application is based on and claims the benefit of priority from Japanese patent application No. 2020-003509 filed on Jan. 14, 2020, which is incorporated by reference in its entirety.

BACKGROUND

The present disclosure relates to a fixing device which fixes a toner image on a sheet and an image forming apparatus including the fixing device.

An electrophotographic type image forming apparatus includes a fixing device which heats a toner image transferred on a sheet. The fixing device includes a heater, a cylindrical fixing belt (a heated member) heated by the heater and a pressing roller (a pressing member) which forms a nip area between the fixing belt and the pressing roller, through which the sheet is passed. The heater is stored inside the fixing belt, for example. When the pressing roller is rotated, the fixing belt is driven to be rotated, and the inner circumferential face of the fixing belt is slid with respect to the heat radiation face of the heater in a sheet conveyance direction.

When the fixing belt and the pressing roller are rotated, the heater is controlled such that the nip area is heated to a predetermined target temperature (a fixing temperature). When the heater is controlled such that heat is applied to the fixing belt from the heater, the heat is transferred from the nip area to the pressing roller through the fixing belt, and the pressing roller is also heated.

As a heating device to heat the fixing belt, a configuration is conventionally known, which is provided with a central heater heating a central portion of the fixing belt and two end heaters heating end portions outside the central portion of the fixing belt.

By the way, in the above described fixing device, all the heaters are connected in parallel by a power supply line to a power supply source. Each power supply line is provided with a switching element which turns on and off the power supply. However, even if any of the switching elements fails and is short-circuited, the corresponding heater may be overheated to an abnormal temperature. Then, the conventional fixing device is provided with a temperature sensor, such as a thermostat or a thermal cut-off element, which measures an abnormal temperature of the heater. However, because the heaters are connected in parallel, there is a problem that it is needed to provide the temperature sensor for each heater.

SUMMARY

In accordance with an aspect of the present disclosure, a fixing device heats a toner image on a sheet at a fixing position on a sheet conveyance path to fix the toner image on the sheet. The fixing device includes a cylindrical heated member and a heating part. The cylindrical heated member is long in a width direction of the sheet, and is supported in a rotatable manner with coming into contact with a fixing face of the sheet. The heating part is provided in an inner space of the heated member and heating an inner circumferential face of the heated member. The heating part includes a plurality of heaters disposed side by side in a longitudinal direction of the heated member; and a first temperature sensor measuring a first heater of the plurality of heaters or a heated area of the heated member heated by the first heater. The plurality of heaters and the first temperature sensor are connected in series by a first power supply line.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, one embodiment of the present invention will be described. The following embodiments are specific examples of the present disclosure and are not intended to limit the technical scope of the present disclosure.

[Configuration of the Image Forming Apparatus]

An image forming apparatus 10 according to the present embodiment is an apparatus performing a printing processing where an image is formed on a sheet 9. The image forming apparatus 10 performs the printing processing in an electrophotographic manner. The sheet 9 is a media on which an image is formed, such as a paper or a sheet-shaped resin member.

Figure 1:
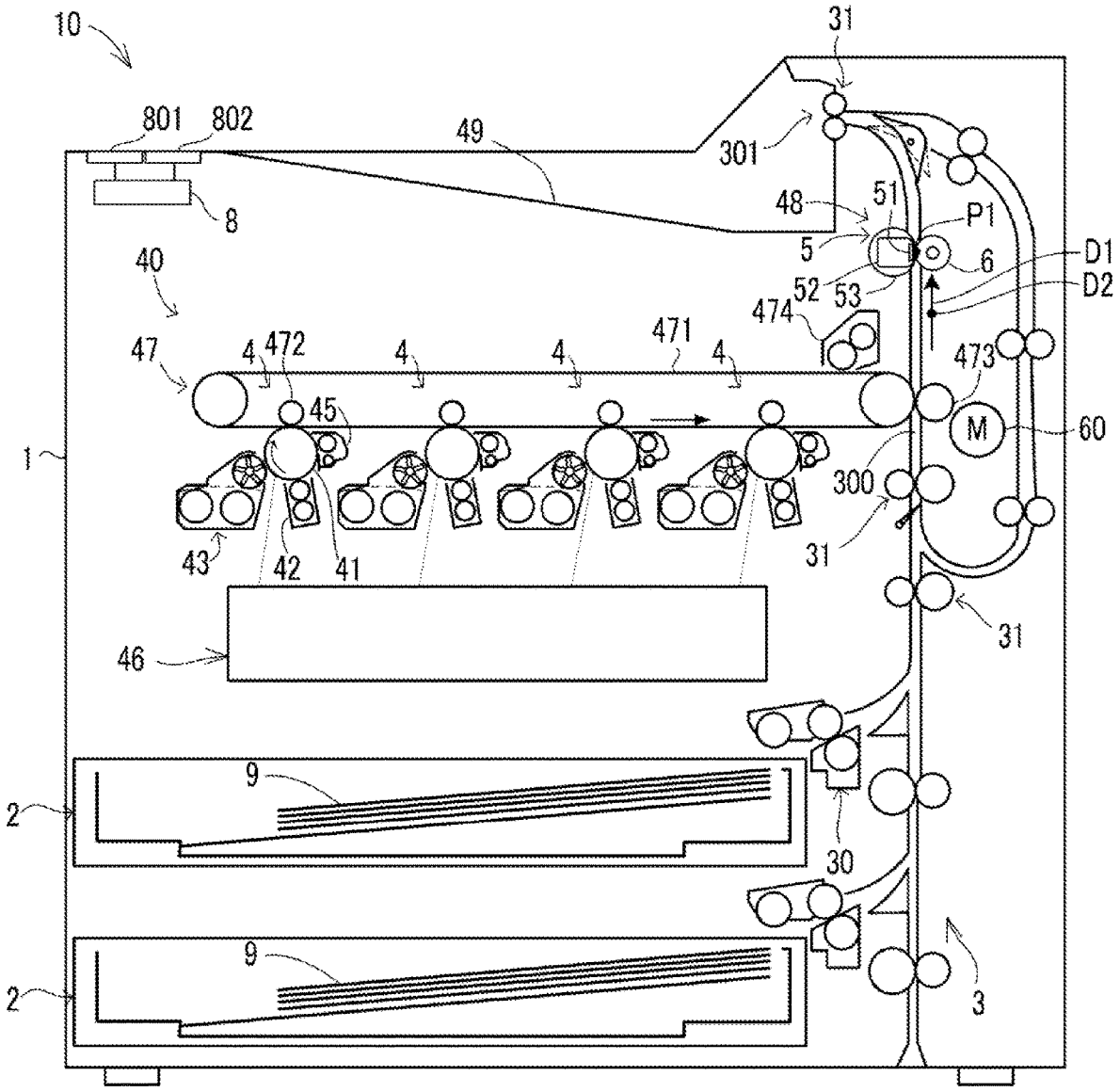
FIG. 1 is a view showing a configuration of an image forming apparatus according to one embodiment of the present disclosure.

As shown in FIG. 1, the image forming apparatus 10 includes a sheet conveyance device 3 provided inside a main body 1, a printing device 40, a controller 8, an operation device 801 and a display device 802.

The sheet conveyance device 3 includes a sheet feeding device 30 and a plurality of conveyance rollers pairs 31. The sheet feeding device 30 feeds the sheet 9 stored in a sheet storage part 2 to a sheet conveyance path 300 in the main body 1.

The conveyance rollers pairs 31 are driven by a motor to be rotated. When the conveyance rollers pair 31 are rotated with the sheet 9 nipped, the sheet 9 is conveyed along the conveyance path 300. Furthermore, the conveyance rollers pair 31 discharges the sheet 9 through a discharge port 301 of the conveyance path 300 on a discharge tray 49. In the following description, a direction in which the sheet 9 is conveyed along the conveyance path 300 is called a sheet conveyance direction D1. A direction perpendicular to the sheet conveyance direction D1 and along the conveyance path 300 (a direction perpendicular to a paper surface on which FIG. 1 is drawn) is called a width direction D2.

The printing device 40 forms a toner image on the sheet 9 conveyed along the conveyance path 300 by the sheet conveyance device 3. The printing device 40 includes an image forming device 4, an optical scanning device 46, a transferring device 47 and a fixing device 48. The image forming device 4 includes a drum-shaped photosensitive member 41, a charging device 42, a development device 43 and a drum cleaning device 45.

The image forming apparatus 10 shown in FIG. 1 is a tandem type color image forming apparatus. Then, the printing device 40 includes the four image forming devices 4 corresponding to toners of four colors (yellow, cyan, magenta and black). The transferring device 47 includes an intermediate transferring belt 471, four belt transferring devices 472 corresponding to the four image forming devices 4, a sheet transferring device 473 and a belt cleaning device 474.

In the image forming device 4, the photosensitive member 41 is rotated, and the charging device 42 charges the surface of the photosensitive member 41. The optical scanning device 46 scans the surface of the photosensitive member 41 with laser light to form an electrostatic latent image on the surface of the photosensitive member 41. The photosensitive member 41 is an example of an image carrier.

Then, the development device 43 supplies the toner on the surface of the photosensitive member 41 to develop the electrostatic latent image into a toner image.

The transferring device 47 transfers the toner image to the sheet 9 on the conveyance path 300. In the transferring device 47, the belt transferring device 472 transfers the toner image on the surface of the photosensitive member 41 to the surface of the intermediate transferring belt 471. Then, a color toner image is formed on the surface of the intermediate transferring belt 471.

The sheet transferring device 473 transfers the toner image formed on the intermediate transferring belt 471 to the sheet 9 on the conveyance path 300.

In a case where the image forming apparatus 10 is a monochrome image forming apparatus, the sheet transferring device 473 transfers the toner image on the photosensitive member 41 to the sheet 9 on the conveyance path 300.

The drum cleaning device 45 removes the toner remaining on the surface of the photosensitive member 41. The belt cleaning device 474 removes the toner remaining on the intermediate transferring belt 471.

The fixing device 48 presses the toner image transferred on the sheet 9 while heating it in a fixing position P1 on the conveyance path 300 to fix the toner image on the sheet 9.

The fixing device 48 includes a heating device 5 (an example of a heating part in the present disclosure), a fixing belt 53 (an example of a heated member in the present disclosure), and a pressing roller 6 as an example of a pressing member. The heating device 5 includes three heaters 51 (51*a*, 51*b* and 51*c*), a supporting member 52, two temperature sensors 56 (56*a* and 56*b*), and a heater power supply circuit 50 (refer to FIG. 4). Specifically, the heating device 5 includes a central heater 51*a*, a first end heater 51*b* and a second end heater 51*c*. The heating device 5 includes a central temperature sensor 56*a* and an end temperature sensor 56*b*. Each heater 51 and each temperature sensor 56 will be described later.

The fixing belt 53 is a cylindrical flexible member. The pressing roller 6 is a roller around which an elastic layer made of rubber sponge material (an elastic material layer) is formed.

The three heaters 51 and the supporting member 52 are provided in the inner hollow space of the fixing belt 53. Each heater 51 heats the fixing belt 53, in detail, the inner circumferential face 53*a* of the fixing belt 53. The heaters 51 are disposed side by side along the width direction D2 at the fixing position P1. Each heater 51 has a plurality of heating resistors disposed side by side along the width direction D2. For example, each heater 51 is a ceramic heater formed into a flat shape or a narrow width thin plate. Each heating resistor is a heating element which converts electricity into heat, and applied with power from a power source 70 (refer to FIG. 3) to generate the heat. Each heater 51 is not limited to have the heating resistor, but may be an IH heater using induction heating, for example.

The supporting member 52 is a member which supports the heaters 51. The heaters 51 and the supporting member 52 are disposed with their longitudinal directions along the width direction D2.

The fixing belt 53 is a flexible cylindrical member. Specifically, the fixing belt 53 is an endless belt-shaped member. For example, the fixing belt 53 is a cylindrical sheet member.

Figure 2:
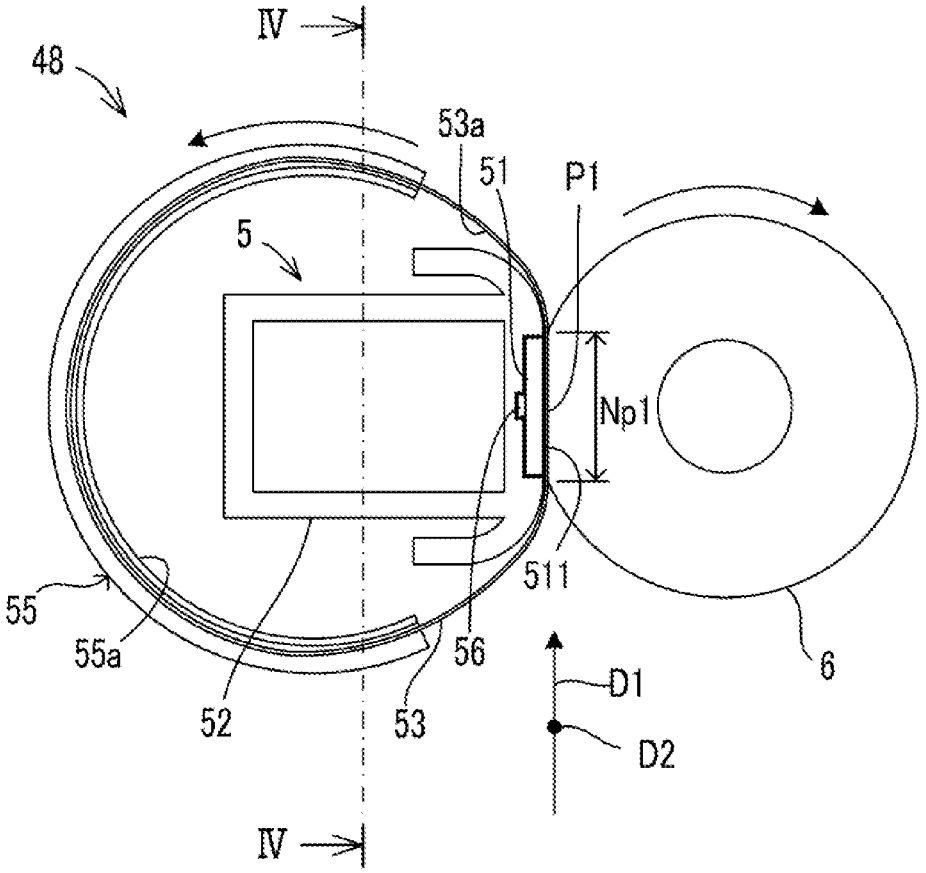
FIG. 2 is a view showing a configuration of a fixing device, in the image forming apparatus according to the embodiment of the present disclosure.

As shown in FIG. 2, the fixing belt 53 is supported in a rotatable manner in a state where the heaters 51 and the supporting member 52 are stored therein. For example, the fixing device 48 includes a pair of guide members 55 each having an arc-shaped protrusion 55*a*.

The pair of guide members 55 is supported in a state where the protrusions 55*a* face the end portions of the inner circumferential face 53*a* of the fixing belt 53 in the width direction D2. Then, the pair of guide members 55 supports the fixing belt 53 in a rotatable manner.

When the fixing belt 53 is rotated around the heaters 51 and the supporting member 52, the inner circumferential face 53*a* of the fixing belt 53 is slid with respect to the heat radiation face 511 of each heater 51 along the sheet conveyance direction D1. On the inner circumferential face 53*a* of the fixing belt 53, lubricant is applied in order to enhance sliding performance between the heat radiation face 511 of each heater 51 and the inner circumferential face 53*a* of the fixing belt 53.

The heater 51 is a member coming into contact with the inner circumferential face 53*a* of the fixing belt 53. That is, the heater 51 is a heating member which radiates heat on the inner circumferential face 53*a* of the fixing belt 53 to heat the fixing belt 53 and also a member coming into contact with the inner circumferential face 53*a* of the fixing belt 53.

The pressing roller 6 is supported in a rotatable manner with biased toward the heater 51. For example, the pressing roller 6 is biased toward the heaters 51 by a biasing member (not shown) such as a spring. The pressing roller 6 is not necessarily biased toward the heaters 51, but, for example, the heaters 51 and the supporting member 52 may be biased toward the pressing roller 6 by a biasing member such as a spring.

As shown in FIG. 2, between the pressing roller 6 and the fixing belt 53, the nip area Np1 is formed, through which the sheet 9 is passed. A position where the nip area Np1 is formed is the fixing position P1.

The pressing roller 6 is driven to be rotated by a rotational driving force input from a motor 60 (refer to FIG. 1). To the controller 8 of the image forming apparatus 10, a motor drive circuit 61 (refer to FIG. 3) to drive the motor is provided, and according to an instruction from the controller 8, the motor drive circuit 61 supplies power to the motor such that the motor 60 rotates at a predetermined rotational speed constantly. As a result, the pressing roller 6 is rotated at a predetermined constant speed. For example, the motor drive circuit 61 is an inverter circuit.

When the pressing roller 6 is rotated, the fixing belt 53 is driven by the pressing roller 6 to be rotated. That is, the rotation of the pressing roller 6 drives the fixing belt 53 to be rotated.

The heater power supply circuit 50 supplies power to the heater 51 according to an instruction from the controller 8. The heater power supply circuit 50 adjust an amount of the power supplied to the heater 51 according to an instruction from the controller 8.

Figure 3:
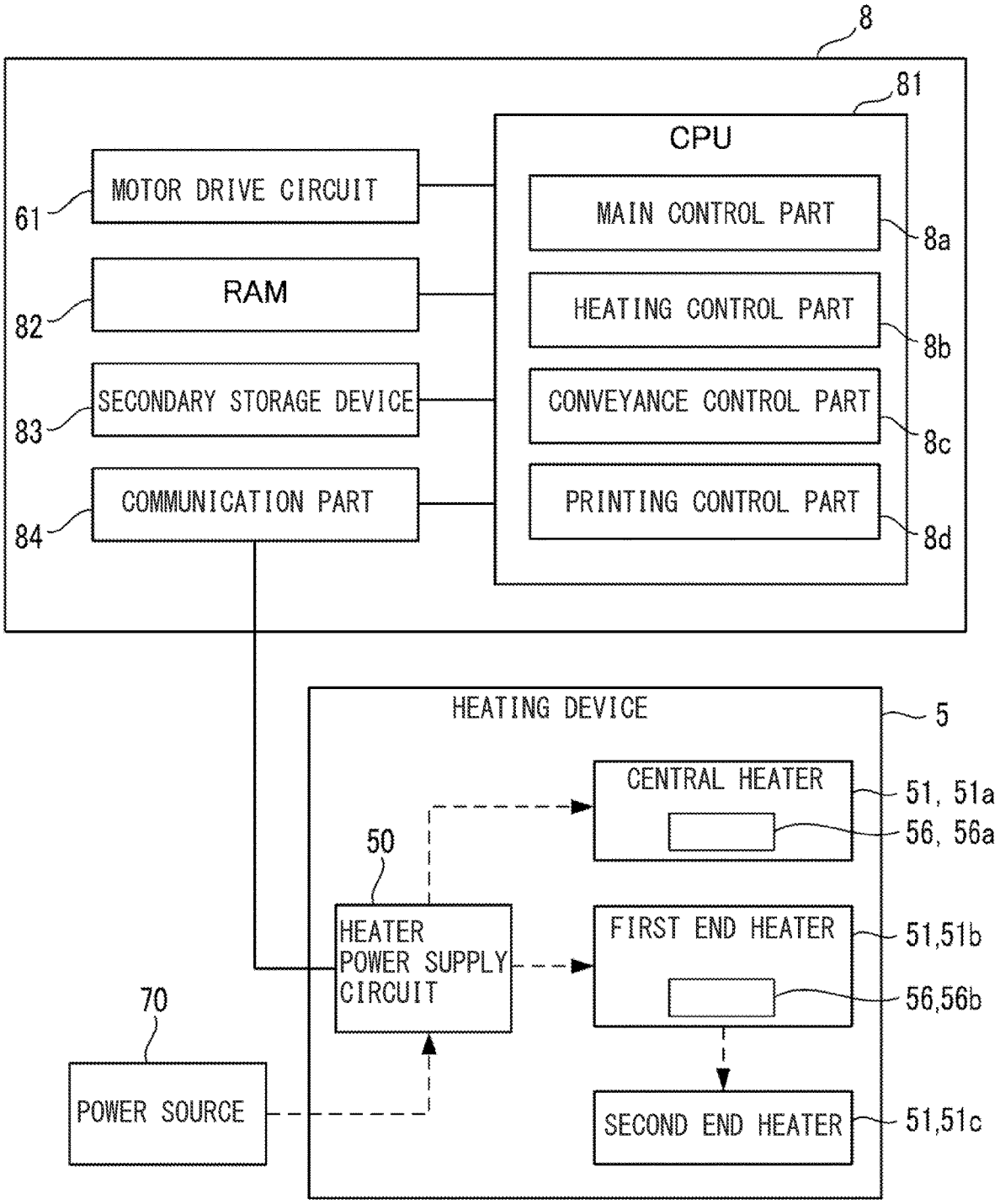
FIG. 3 is a block diagram showing a controller, in the image forming apparatus according to one embodiment of the present disclosure.
Figure 4:
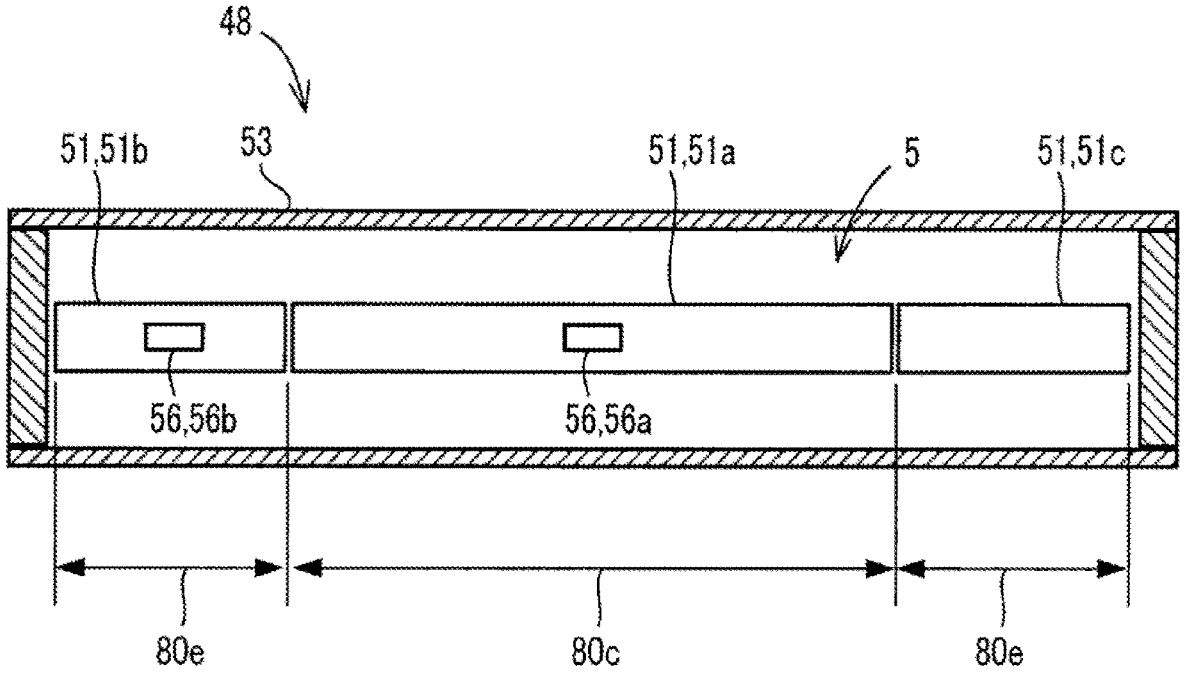
FIG. 4 is a sectional view taken along the line IV-IV in FIG. 2, and showing an arrangement of a plurality of heaters of a heating device of the fixing device.

As shown in FIG. 3 and FIG. 4, the heating device 5 includes the two temperature sensors 56 (56*a* and 56*b*) which measure temperature of the heaters 51. Each temperature sensor 56 is a sensor used for a feedback control to keep a temperature of the heater 51 at the predetermined target temperature (the fixing temperature). Each temperature sensor 56 is directly mounted to the heater 51, and connected in series to power supply lines L1, L2 (refer to FIG. 5) which supply power to the heater 51. For example, the temperature sensor 56 is a thermostat as a protection element which outputs a signal indicative a measured temperature and breaks the internal conductive part to disconnect the power supply line when an abnormal temperature is measured. The target temperature is a temperature of the nip area Np1 at which the toner image can be fixed on the sheet 9.

The temperature measured by the temperature sensor 56 is a temperature serving as an alternate index showing a temperature of the fixing position P1, that is, the nip area Np1. In other words, the temperature sensor 56 measures the temperature serving as the alternative index showing the temperature of the nip area Np1.

The controller 8 (refer to FIG. 1) executes various data processing and control of the devices, such as the sheet conveyance device 3, the printing device 40 and the display device 802.

As shown in FIG. 3, the controller 8 includes a central processing unit (CPU) 81, a random access memory (RAM) 82, a secondary storage device 83 and a peripheral device such as a communication part 84. The controller 8 is connected to the heating device 5, and controls the heating of the heating device 5 and controls the heating device 5 so as to heat the nip area Np1 to the above described target temperature.

The CPU 81 is a processer which executes various data processing and predetermined control by executing a computer program. The RAM 82 is a computer readable volatile storage device. The RAM 82 primarily stores the computer program executed by the CPU 81 and data output and referred to in a process of the executing various processing by the CPU 81.

The CPU 81 includes a plurality of processing modules achieved by executing the above described computer program. The plurality of processing modules includes a main control part 8*a*, a heating control part 8*b*, a conveyance control part 8*c* and a printing control part 8*d*. In the other words, the control device 8 includes the main control part 8*a*, the heating control part 8*b*, the conveyance control part 8*c* and the printing control part 8*d*.

The main control part 8*a* executes various processing according to an operation for the operation device 801 and a signal input from an external device, and also executes a control of the display device 802.

The heating control part 8*b* adjusts an amount of power supplied to the heating device 5 so as to heat the nip area Np1 to the target temperature by feedback control based on a comparison of a temperature measured by each temperature sensor 56 with the previously set target temperature. Specifically, the heating control part 8*b* controls the heater power supply circuit 50 to adjust an amount of power supplied to each heater 51 and to control the heating by each heater 51.

The conveyance control part 8*c* controls the sheet conveyance device 3. The printing control part 8*d* controls the printing device 40 to execute the printing processing in synchronization with the conveyance of the sheet 9.

The secondary storage device 83 is a computer readable non-volatile storage device. The secondary storage device 83 enables a storage processing of the computer program and various data and an updating processing. For example, one or both a flash memory and a hard disk drive are used as the secondary storage device 83.

The communication part 84 is a signal interface, converts a signal output from various sensor such as the temperature sensor 56 into a digital data, and transmits the converted digital data to the CPU 81. Furthermore, the communication part 84 converts a control instruction output from the CPU 81 into a control signal, and transmits the control signal to the device to be controlled.

By the way, in a conventional fixing device, a plurality of heaters is connected in parallel to a power supply source by power supply lines. Each power supply line is provided with a switching element for turning on and off the power supply. Even if any of the switching elements fails and is short-circuited, the corresponding heater may be overheated to an abnormal temperature. Then, the conventional fixing device is provided with a temperature sensor to measure an abnormal temperature of the heater, such as a thermostat and a thermal cutoff element. However, because the heaters are connected in parallel, there is a problem that it is necessary to provide the temperature sensor for each heater.

On the other hand, in the fixing device according to the present embodiment, the heaters are connected in series, as described below. Then, it is sufficient to provide one heater for the heaters connected in series. Accordingly, it becomes possible to reduce the number of the temperature sensor and to make a structure of the internal circuit of the heating device 5 simple.

FIG. 4 is a view showing an arrangement of the heaters 51 of the heating device 5. As shown in FIG. 4, the heating device 5 includes the three heaters 51 (51*a*, 51*b* and 51*c*) disposed side by side in a longitudinal direction of the fixing belt 53 (the width direction D2) in the hollow inner space of the fixing belt 53.

Specifically, the heating device 5 includes the central heater 51*a*, the first end heater 51*b* and the second end heater 51*c*. The central heater 51*a* is an example of a central heater in the present disclosure, and the first end heater 51*b* is an example of a first heater in the present disclosure. The first end heater 51*b* and the second end heater 51*c* are an example of a plurality of heaters in the present disclosure. Each heater heats the inner circumferential face 53*a* of the fixing belt 53.

The central heater 51*a* heats the longitudinal central portion 80*c* of the fixing belt 53, and is disposed so as to correspond to the central portion 80*c*. The first end heater 51*b* and the second end heater 51*c* are disposed side by side in the longitudinal direction of the fixing belt 53, and they form one pair. In detail, the first end heater 51*b* and the second end heater 51*c* are disposed such that the central heater 51*a* is disposed between both end heaters. The first end heater 51*b* and the second end heater 51*c* heat the end portions 80*e* outside the central portion 80*c* in the longitudinal direction, and are disposed so as to correspond to the end portions 80*e*. In the present embodiment, the central heater 51*a*, the first end heater 51*b* and the second end heater 51*c* are disposed in a line along the longitudinal direction of the fixing belt 53.

The fixing belt 53 is formed to have a length contactable with a maximum size sheet 9 which can be fixed by the fixing device 48. In the present embodiment, the A3 size sheet (420 mm×297 mm) can be fixed by the fixing device 48, and the fixing belt 53 is formed to have a length longer than a shorter side length (297 mm) of the A3 size sheet. For the fixing belt 53, the central heater 51*a* is configured to heat the central portion 80*c* having the same length as the shorter side length of the A4 size sheet (297 mm×210 mm) with respect to a longitudinal center of the fixing belt 53. For the above fixing belt 53, the first end heater 51*b* and the second end heater 51*c* are configured to heat the end portions 80*e* extending from the longitudinal outer edges of the central portion 80*c* to the longitudinal outer edges of the fixing belt 53.

The heating device 5 includes the two temperature sensors 56 (56*a* and 56*b*). The central temperature sensor 56*a* is provided on the surface of the central heater 51*a*, and the end temperature sensor 56*b* is provided on the surface of the first end heater 51*b*. The central temperature sensor 56*a* is an example of the second temperature sensor in the present disclosure, and the end temperature sensor 56*b* is an example of a first temperature sensor in the present disclosure. The second end heater 51*c* is not provided with a temperature sensor.

The central temperature sensor 56*a* is directly mounted on the surface of the central heater 51*a* which is a temperature measurement object, and measures a temperature of the central heater 51*a* directly. A sensor signal output from the central temperature sensor 56*a* is transmitted to the controller 8, and the controller 8 calculates a temperature of the central heater 51*a* based on the sensor signal.

The end temperature sensor 56*b* is directly mounted on the surface of the first end heater 51*b* which is a temperature measurement object, and measures a temperature of the first end heater 51*b* directly. A sensor signal output from the end temperature sensor 56*b* is transmitted to the controller 8, and the controller 8 calculates a temperature of the first end heater 51*b* based on the sensor signal.

Figure 5:
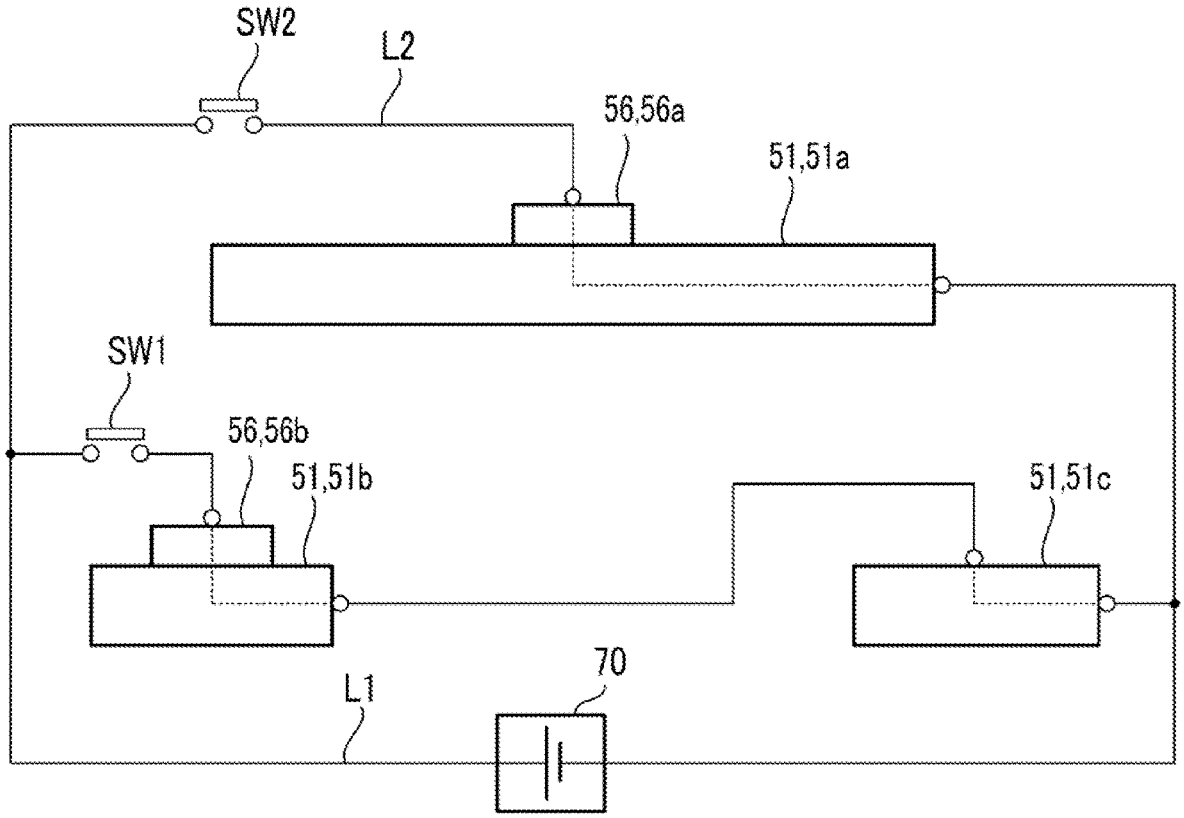
FIG. 5 is a view showing a connection state of power supply lines of the plurality of heaters.

FIG. 5 is a view showing a connection state of the power supply lines L1 and L2 of the heaters 51. As shown in FIG. 5, to each of the first end heater 51*b* and the second end heater 51*c*, the first power supply line L1 is connected, and power is supplied from the power source 70 through the first power supply line L1. In the present embodiment, the first end heater 51*b* and the second end heater 51*c* are connected in series by the first power supply line L1. The end temperature sensor 56*b* is connected in series to the first power supply line L1. On the first power supply line L1, an electromagnetic contactor SW1 to connect and disconnect the first power supply line L1 is provided. The electromagnetic contactor SW1 is controlled by the controller 8 to be turned on and off.

To the central heater 51*a*, the second supply line L2 connected to the first power supply line L1 in parallel is connected. That is, the central heater 51*a* is provided in parallel to the first end heater 51*b* and the second end heater 51*c*. To the central heater 51*a*, power is supplied from the power source 70 through the second power supply line L2. The central temperature sensor 56*a* is connected in series to the second power supply line L2. On the second power supply line L2, an electromagnetic contactor SW2 to connect and disconnect the second power supply line L2 is provided. The electromagnetic contactor SW2 is controlled by the controller 8 to be turned on and off.

As described above, the heaters 51 are connected by the first power supply line L1 and the second power supply line L2, as shown in FIG. 5, so that even if the electromagnetic contactor SW1 fails and is short-circuited and it becomes impossible to stop the power supply to the first end heater 51*b* and the second end heater 51*c*, the end temperature sensor 56*b* measures an abnormal temperature higher than the target temperature, and breaks the internal conductive part to disconnect the first power supply line. Therefore, it becomes possible to stop the power supply to the first end heater 51*b* and the second end heater 51*c* and to prevent the abnormal heating by each of the heaters 51*b* and 51*c*. According to the configuration, by providing one end temperature sensor 56*b* for the first end heater 51*b* and the second end heater 51*c*, it becomes possible to prevent the first end heater 51*b*, the second end heater 51*c* and the devices on the first power supply line L1 from being overheated owing to the short-circuit. As a result, it becomes possible to reduce the number of the temperature sensor and to make a structure of the internal circuit of the heating device 5 simple.

The first end heater 51*b* and the second end heater 51*c* are disposed so as to heat both end portions 80*e* of the fixing belt 53. In a case of the sheet 9 having the fixable maximum width, when the sheet 9 passes through the nip area Np1, heat is taken from the central portion 80*c* and both end portions 80*e* of the fixing belt 53 to the sheet 9, so that the temperatures of the central portion 80*c* and both end portions 80*e* are lowered. However, in a case of the sheet 9 having a width narrower than the maximum width, when the sheet 9 passes through the nip area Np1, the temperature of the central portion 80*c* is lowered by heat taken from the central portion 80*c* to the sheet 9, while the temperature of both end portions 80*e* is hardly lowered because the sheet 9 does not come into contact with both end portions 80*e*. Therefore, by measuring the temperature of one of the end portions 80*e* by the end temperature sensor 56*b*, the abnormal temperature of the fixing belt 53 can be detected more quickly.

Further, because the end temperature sensor 56*b* is a thermostat that breaks the internal conductive part and disconnect the first power supply line L1 when an abnormal temperature is measured, it becomes possible to make the control of the heating device 5 simple.

The above embodiment illustrates a configuration that the central heater 51*a* is connected to the second power supply line L2, and the first end heater 51*b* and the second end heater 51*c* are connected in series to the first power supply line L1. However, the present disclosure is not limited to the above configuration. For example, the central heater 51*a*, the first end heater 51*b*, and the second end heater 51*c* may be connected in series to a common power supply line. In this case, it is sufficient to provide one temperature sensor for each heater 51.

The above embodiment describes an example where the temperature sensor 56 directly measures the temperature of the heater 51, but, for example, the temperature sensor 56 may measure the temperature of a heated area on the inner circumferential face 53*a* of the fixing belt 53 heated by the heater 51. In this case, the temperature sensor 56 is a non-contact type temperature sensor for measuring the temperature by measuring infrared rays emitted from the heated area. In this configuration, the controller 8 controls the corresponding electromagnetic contactors SW1 or SW2 to be turned on or off when determining that the temperature of the heated area has reached an abnormal temperature based on the sensor output from the temperature sensor 56.

Further, the present disclosure may be taken as a disclosure of the image forming apparatus 10 including the fixing device 48, or may be taken as a disclosure of the fixing device 48 alone.

The invention claimed is:

1. A fixing device which heats a toner image on a sheet at a fixing position on a sheet conveyance path to fix the toner image on the sheet, the fixing device comprising:

a cylindrical heated member long in a width direction of the sheet, which is supported in a rotatable manner with coming into contact with a fixing face of the sheet; and a heating part provided in an inner space of the heated member and heating an inner circumferential face of the heated member, wherein the heating part includes:

a plurality of heaters disposed side by side in a longitudinal direction of the heated member; and a first temperature sensor measuring a first heater of the plurality of heaters or a heated area of the heated member heated by the first heater, wherein the plurality of heaters and the first temperature sensor are connected in series by a first power supply line.

2. The fixing device according to claim 1, further comprising a controller which connects or disconnects the first power supply line and to which a measurement result of the first temperature sensor is input, wherein the controller disconnects the first power supply line when it is determined that a temperature of the first heater or the heated area is an abnormal temperature higher than a target temperature based on the measurement result of the first temperature sensor.

3. The fixing device according to claim 1, wherein the heating part further includes:

a central heater heating a longitudinal central portion of the heated member; and a second temperature sensor measuring a temperature of the central heater or the central portion, wherein the plurality of heaters is a pair of end heaters which heat end portions outside the central portion of the heated member, the first heater is one of the pair of end heaters, and the central heater is connected to the pair of end heaters in parallel by a second power supply line.

4. The fixing device according to claim 1, wherein the heating part further includes a central heater heating a longitudinal central portion of the heated member, and the plurality of heaters, the central heater and the first temperature sensor are connected in series by the first power supply line.

5. The fixing device according to claim 1, wherein the first temperature sensor is a thermostat.

6. An image forming apparatus comprising:

a transferring device which transfers a toner image on a sheet; and the fixing device according to claim 1, which fixes the toner image on the sheet.

* * * * *